US006302605B1

(12) United States Patent
Kanbe

(10) Patent No.: US 6,302,605 B1
(45) Date of Patent: Oct. 16, 2001

(54) ROTARY CUTTER APPARATUS FOR PRINTER WITH FULL AND PARTIAL CUTTING MODES

(75) Inventor: Hideo Kanbe, Shizuoka (JP)

(73) Assignee: Star Micronics Co., Ltd., Shizuoka (JP)

( * ) Notice: Subject to any disclaimer, the term of this patent is extended or adjusted under 35 U.S.C. 154(b) by 0 days.

(21) Appl. No.: 09/549,577

(22) Filed: Apr. 14, 2000

(30) Foreign Application Priority Data

Apr. 14, 1999 (JP) ..... 11-107142
May 7, 1999 (JP) ..... 11-127431

(51) Int. Cl.[7] ..... B41J 11/70; B26D 1/18; B26D 1/20; B26D 1/10

(52) U.S. Cl. ..... 400/621; 83/614; 83/678; 83/660

(58) Field of Search ..... 400/621; 83/886, 83/676, 671, 668, 614, 660, 678, 695

(56) References Cited

U.S. PATENT DOCUMENTS

| | | | | |
|---|---|---|---|---|
| 3,850,068 | | 11/1974 | Bradam | 83/529 |
| 3,978,752 | | 9/1976 | Meaden et al. | 83/678 |
| 4,003,281 | | 1/1977 | Kumpf et al. | 83/477.2 |
| 4,085,621 | | 4/1978 | Hadaway | 74/37 |
| 4,517,872 | * | 5/1985 | Dontscheff | 83/471.2 |
| 4,525,088 | * | 6/1985 | Shipos et al. | 400/621 |
| 4,981,059 | * | 1/1991 | Kobayashi | 400/621 |
| 5,168,786 | * | 12/1992 | Huggins et al. | 83/308 |
| 5,531,530 | * | 7/1996 | Kuramoto et al. | 400/621 |
| 5,596,918 | | 1/1997 | Longwell et al. | 83/332 |
| 6,076,446 | * | 6/2000 | Onishi et al. | 83/487 |
| 6,102,596 | * | 8/2000 | Komori et al. | 400/621 |

FOREIGN PATENT DOCUMENTS

| | | | |
|---|---|---|---|
| 0 359 583 | 3/1990 | (EP) | B41J/11/70 |
| 0 901 890 | 3/1999 | (EP) | B26D/1/20 |
| 2 729 336 | 7/1996 | (FR) | B41J/11/70 |
| 61-3158 | 1/1986 | (JP) | G03G/15/00 |
| 62-70170 | 3/1987 | (JP) | B65H/45/101 |
| 6-238596 | 8/1994 | (JP) | B26F/1/20 |
| 10-006278 | 1/1998 | (JP) | B26D/1/18 |
| 10-29193 * | 2/1998 | (JP) . | |

* cited by examiner

*Primary Examiner*—Daniel J. Colilla
(74) *Attorney, Agent, or Firm*—Sughrue, Mion, Zinn, Macpeak & Seas, PLLC

(57) ABSTRACT

A cutter apparatus 6 includes a rotary cutter 10 which is rotatably supported and has a cutting edge formed on the circumference thereof, a fixed cutter 20 cooperating with the rotary cutter 10 to hold a sheet member between them, a carriage 11 for moving the rotary cutter 10 in a reciprocating manner along a cutting line, and a stopper 22 used to switch a full cutting mode in which the cutting point of the rotary cutter 10 is allowed to pass through the side end of a record sheet S to a partial cutting mode in which the cutting point of the rotary cutter 10 is caused to stop before the side end of the record sheet S or vice versa. As another structure, a cutter apparatus 6 includes: a rotary cutter 10 supported rotatably and having a cutting edge formed on the circumference thereof, the cutting edge including a notch portion formed in part thereof; a fixed cutter 20 cooperating with the rotary cutter 10 in holding a record sheet S between them; a carriage 11 for moving the rotary cutter 10 along a cutting line; and, an eccentric guide shaft for switching the cutting depth of the rotary cutter 10 with respect to the record sheet S.

6 Claims, 7 Drawing Sheets

ROTARY CUTTER APPARATUS FOR PRINTER WITH FULL AND PARTIAL CUTTING MODES

BACKGROUND OF THE INVENTION

1. Field of the Invention

The present invention relates to a cutter apparatus for cutting a sheet member and a printer using the cutter apparatus.

2. Description of the Related Art

A POS register installed at an account counter in a retail shop includes a print unit which is used to issue a receipt for each payment when the payment is completed. A receipt sheet is generally stored as a roll of sheet, and as a mechanism for separating a receipt from the roll of sheet, there have been known a) a mechanism of a tear-bar system in which an operator tears a receipt from the sheet, and b) a mechanism of an automatic cutting system in which a receipt is electrically cut off from the sheet after printing is completed.

When a customer does not request a receipt, in the tear-bar system, receipts issued previously and currently are continuous with each other in a single receipt manner, and therefore, it is easy to deal with unnecessary receipts afterwards. However, in the automatic cutting system, since a receipt is automatically torn or cut each time payment is made, it is very complicated to keep and handle unnecessary receipts.

In view of the above, there has been proposed a mechanism of a partial cutting system which does not entirely cut receipts but cuts receipts in such a manner that receipts are connected with one another only in the parts thereof. In this partial cutting system, a receipt can be cut easily when it is handed to a customer and the cutting surface thereof is clean, and when a receipt is not necessary, it is connected to the remaining receipts in a sheet, which makes it easy to deal with the unnecessary receipts later.

Of partially cut portions in this manner, a cut portion having a fine cutting pitch is also referred to as perforations; and such perforations are used in many fields including not only a receipt but also a flier, an inserted bill in a magazine, a questionnaire, and toilet paper.

As the related prior art, there have been known, for example, Japanese Patent Unexamined Publication No. Hei 10-29193, Japanese Patent Unexamined Publication No. Hei 6-238596, Japanese Patent Unexamined Publication No. Sho 62-70170, Japanese Patent Unexamined Publication No. Sho 61-3158, and Japanese Utility Model Unexamined Publication No. Sho 62-144191.

In Japanese Patent Unexamined Publication No. Hei 10-29193, there has been proposed a circle cutter in which a disk-shaped movable cutting edge is attached to a timing belt disposed between two pulleys and the movable cutting edge is reciprocatingly moved to cut a long sheet. However, since the circle cutter is of a full-cutting system that cuts all sections of the sheet, it cannot still solve the above-mentioned problems.

Also, in Japanese Patent Unexamined Publication No. Hei 6-238596, there has been proposed a cutting apparatus structured such that a rotary cutter with notches formed therein is moved in a reciprocating manner to cut a roll of recording paper in which perforations are to be formed. However, this cutting apparatus is directed to a cutter which is designed specially for forming perforations, and when a user wishes to change this apparatus to a full-cutting system, it is indispensable to replace the rotary cutter with a cutter designed exclusively for full cutting. Further, Japanese Patent Unexamined Publication No. Sho 62-70170 and Japanese Patent Unexamined Publication No. Sho 61-3158 similarly disclose a cutter which is designed specially for cutting perforations.

Japanese Utility Model Unexamined Publication No. Sho 62-144191 discloses a cutting apparatus in which a freely rotatable circular cutter is moved linearly along a groove formed in a feed shaft, and perforations can be formed by changing the cutter to a serrated circular cutter.

SUMMARY OF THE INVENTION

The present invention aims at eliminating the drawbacks found in the above-mentioned conventional cutting devices. Accordingly, it is an object of the invention to provide a cutting apparatus which, with no need for the operation to replace the rotary cutter, can be changed between a full cutting system for cutting all sections of a sheet and a partial cutting system for cutting part of the sections of the sheet, and a printer using such cutting apparatus.

In attaining the above object, according to a first aspect of the invention, there is provided a cutter apparatus, comprising: a rotary cutter supported rotatably and having a cutting edge formed on the circumference thereof; an opposite cutter disposed opposed to the rotary cutter for holding a sheet member between the rotary cutter and itself; a carriage mechanism for moving the rotary cutter reciprocatingly along a cutting line; and cutting range switching means for switching a full cutting mode, in which the cutting point of the rotary cutter is allowed to pass through the side end of the sheet member, to a partial cutting mode in which the cutting point of the rotary cutter is caused to stop before the side end of the sheet member, or vice versa.

According to the first aspect of the invention, by switching the cutting range of the rotary cutter, the full cutting mode for cutting all sections of the sheet member or the partial cutting mode for cutting parts of the sections of the sheet member can be selected simply. That is, in case where the cutting range of the rotary cutter is set such that the cutting point of the rotary cutter is allowed to pass through the side end of the sheet member, there is obtained the full cutting mode for cutting the sheet member over the whole width thereof. On the other hand, in case where the cutting range of the rotary cutter is set such that the cutting point of the rotary cutter is caused to stop before the side end of the sheet member, there is obtained the partial cutting mode in which an uncut portion is produced in the side end of the sheet member. Therefore, by switching the moving range of the rotary cutter, the full cutting mode or partial cutting mode can be set easily, thereby being able to save labor which has been conventionally required to replace two kinds of exclusively designed cutters with each other each time the need arises.

According to a second aspect of the invention, in a cutter apparatus as set forth in the first aspect, the cutting range switching means is composed of a stopper the mounting position of which is variable, and the carriage mechanism comprises a carriage for supporting said rotary cutter, a pair of pulleys respectively disposed at the two ends of the sheet member, an endless belt disposed so as to extend between and over the pulleys, and a clutch mechanism which, each time the carriage is contacted with the stopper, switches the belt section to be engaged by the carriage from the forward-going side belt section of the endless belt to the return side belt section of the endless belt or vice versa.

According to the second aspect of the invention, due to provision of the clutch mechanism, each time the carriage is contacted with the stopper, capable of switching the belt section to be engaged by the carriage from the forward-going side belt section of the endless belt to the return side belt section of the endless belt or vice versa, simply by changing the mounting position of the stopper, the moving range of the rotary cutter can be switched. Therefore, the full cutting mode or partial cutting mode can be set easily according to the mounting position of the stopper.

Also, since the reciprocating motion of the carriage can be realized even if the moving direction of the endless belt is one direction, as the motor for driving the pulleys, there can be used a motor of a one-way rotation type such as a DC brush motor which is inexpensive. This can save the use of an expensive reversible motor such as a pulse motor as well as a reversible gear mechanism, thereby being able to reduce the cost of the cutter apparatus.

According to a third aspect of the invention, there is provided a printer comprising:

a sheet delivery mechanism for delivering a sheet member;

a print mechanism for printing the sheet member; and a cutter mechanism for cutting the sheet member after it has passed through the print mechanism;

wherein the cutter mechanism comprises: a rotary cutter supported rotatably and having a cutting edge formed on the circumference thereof; a cutter disposed opposed to the rotary cutter for holding the sheet member between the rotary cutter and itself; a carriage mechanism which moves the rotary cutter reciprocatingly along a cutting line; and, cutting range switching means for switching a full cutting mode, in which the cutting point of the rotary cutter is allowed to pass through the side end of the sheet member, to a partial cutting mode in which the cutting point of the rotary cutter is caused to stop before the side end of the sheet member, or vice versa.

According to the third aspect of the invention, by switching the cutting range of the rotary cutter, the full cutting mode for cutting all sections of the sheet member or the partial cutting mode for cutting part of the sections of the sheet member can be selected simply. That is, in case where the cutting range of the rotary cutter is set such that the cutting point of the rotary cutter is allowed to pass through the side end of the sheet member, there is obtained the full cutting mode for cutting the sheet member over the whole width thereof. On the other hand, in case where the cutting range of the rotary cutter is set such that the cutting point of the rotary cutter is caused to stop before the side end of the sheet member, there is obtained the partial cutting mode in which an uncut portion is produced in the side end of the sheet member. Therefore, by switching the moving range of the rotary cutter, the full cutting mode or partial cutting mode can be set easily, thereby being able to save labor which has been conventionally required to replace two kinds of exclusively designed cutters with each other each time the need arises.

According to a fourth aspect of the invention, there is provided a cutter apparatus, comprising:

a rotary cutter supported rotatably and having a cutting edge formed on the circumference thereof, the cutting edge including a notch portion formed in part thereof;

a cutter disposed opposed to the rotary cutter for holding a sheet member between them;

a carriage mechanism for moving the rotary cutter along a cutting line; and a rotary cutter moving mechanism for switching the cutting depth of the rotary cutter with respect to the sheet member.

According to the fourth aspect of the invention, the relative position between the rotary cutter and sheet member can be switched by the rotary cutter moving mechanism, which makes it possible to select simply a full cutting mode for cutting all sections of the sheet member or a partial cutting mode for cutting part of the sections of the sheet member. That is, by adjusting the relative position such that the cutting depth of the rotary cutter with respect to the sheet member is set in the intermediate position of the notch portion, the bottom portion of the notch portion is not contacted with the sheet member, which provides the partial cutting mode. On the other hand, in case where the relative position is adjusted such that the cutting depth of the rotary cutter with respect to the sheet member is set larger than the depth of the notch portion, there is left no uncut portion, which provides the full cutting mode. Therefore, by switching the cutting depth of the rotary cutter, the full cutting mode or partial cutting mode can be set easily, which can save the conventionally required labor to change two kinds of exclusively designed rotary cutters over to each other each time the need arises.

According to a fifth aspect of the invention, in a cutter apparatus as set forth in the fourth aspect of the invention, in the circumference of the rotary cutter, there are formed a plurality of notch portions differing in the notch depth from one another.

According to the fifth aspect of the invention, in the case where there are formed a plurality of notch portions differing in the notch depth from one another in the circumference of the rotary cutter and the cutting depth of the rotary cutter is adjusted step by step according to the cutting depths, the number of uncut portions in the partial cutting mode can be adjusted arbitrarily. For example, when severability is important, the number of uncut portions may be set small to thereby be able to widen the distance between the uncut portions, and when the connecting strength is important, the number of uncut portions may be set large to thereby be able to narrow the distance between the uncut portions. In this manner, the freedom of the partial cutting mode can be enhanced.

Further, according to a sixth aspect of the invention, there is provided a printer, comprising:

a sheet delivery mechanism for delivering a sheet member;

a print mechanism for printing the sheet member; and, a cutter mechanism for cutting the sheet member which has passed through said print mechanism, wherein the cutter mechanism comprises:

a rotary cutter supported rotatably and having a cutting edge formed on the circumference thereof, said cutting edge including a notch portion formed in part thereof;

a cutter disposed opposed to the rotary cutter for holding the sheet member between them;

a carriage mechanism for moving the rotary cutter along a cutting line; and a rotary cutter moving mechanism for switching the cutting depth of the rotary cutter with respect to the sheet member.

According to the sixth aspect of the invention, the relative position between the rotary cutter and sheet member can be switched by the rotary cutter moving mechanism, which makes it possible to select simply a full cutting mode for cutting all sections of the sheet member or a partial cutting mode for cutting part of the sections of the sheet member. That is, by adjusting the relative position such that the cutting depth of the rotary cutter with respect to the sheet member is set in the intermediate position of the notch portion, the bottom portion of the notch portion is not contacted with the sheet member, which provides the partial cutting mode. On the other hand, in case where the relative position is adjusted such that the cutting depth of the rotary cutter with respect to the sheet member is set larger than the depth of the notch portion, there is left no uncut portion, which provides the full cutting mode. Therefore, by switching the cutting depth of the rotary cutter, the full cutting mode or partial cutting mode can be set easily, which can save the conventionally required labor to change two kinds of exclusively designed rotary cutters over to each other each time the need arises.

BRIEF DESCRIPTION OF THE DRAWINGS

FIGS. 2A to 2C show the structure of a cutter apparatus according to the first embodiment of the invention, in which FIG. 2A is a plan view of the cutter apparatus; FIG. 2B is a front view thereof; and FIG. 2C is a side view thereof;

FIGS. 3A and 3B are explanatory view showing the operation of a partial cutting mode to be executed by the cutter apparatus according to the first embodiment of the invention, in which FIG. 3A is a plan view of the cutter apparatus, and FIG. 3B is a front view thereof;

FIGS. 4A to 4C show the structure of a cutter apparatus according to a second embodiment of the invention, in which FIG. 4A is a plan view thereof, FIG. 4B is a front view thereof, and FIG. 4C is a side view thereof;

DETAILED DESCRIPTION OF THE PREFERRED EMBODIMENTS

Now, a description will be given in more detail of preferred embodiments of the present invention with reference to the accompanying drawings.

A first embodiment of the invention will be described.

Figure 1:
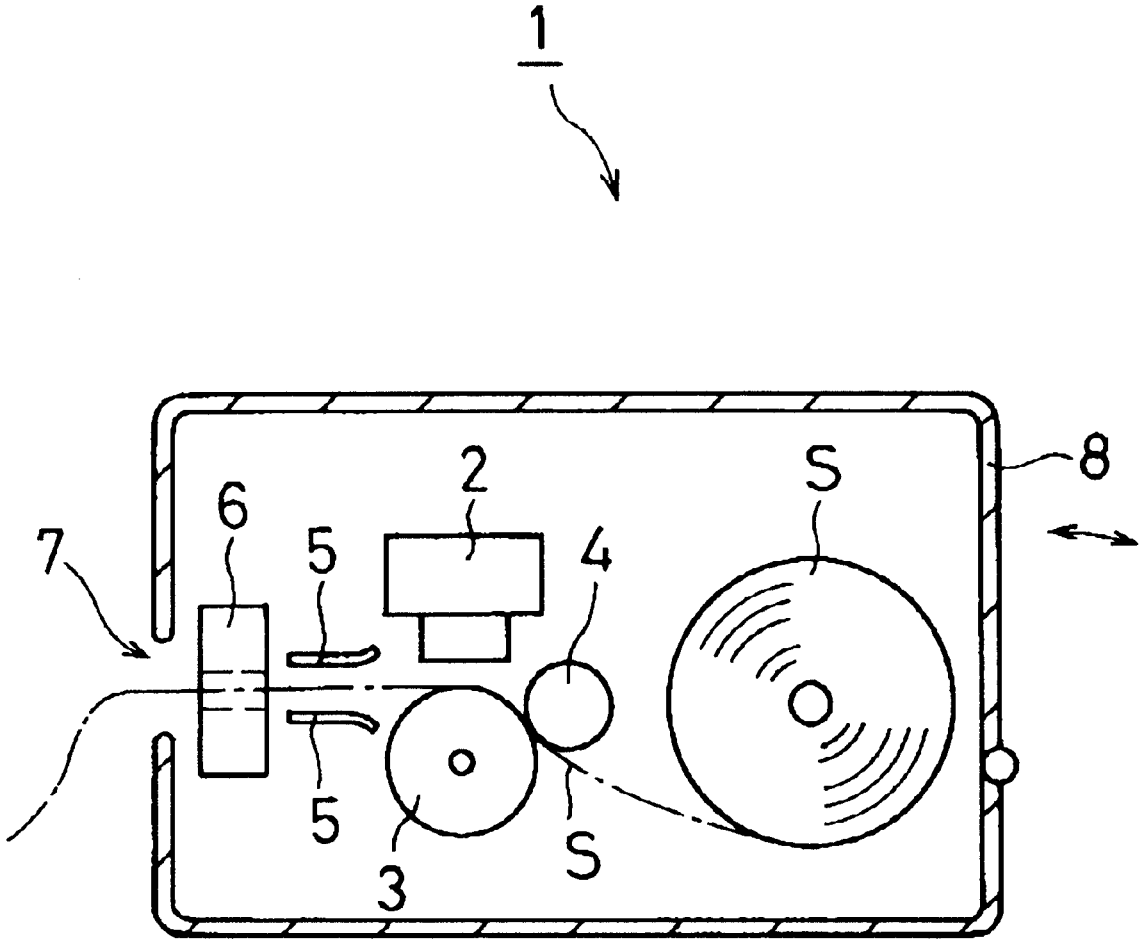
FIG. 1 is a section view showing the internal structure of a printer according to a first embodiment of the invention.

FIG. 1 is a section view of the internal structure of a printer according to a first embodiment of the invention. The printer 1 includes a print head 2 for executing a serial type print or a line type print, a platen 3 disposed opposed to the print head 2 with a record sheet S between them, a feed roller 4 for feeding the record sheet S together with the platen 3, two guide members 5 for guiding the record sheet S, and a cutter apparatus 6 for cutting the record sheet S, which has passed through the print head 2, at a desired position fully or partially. The record sheet S before being printed is mounted in a roll shape within a housing 8, whereas the record sheet, after it is cut by the cutter apparatus 6, is discharged from a discharge opening 7.

Figure 2A:
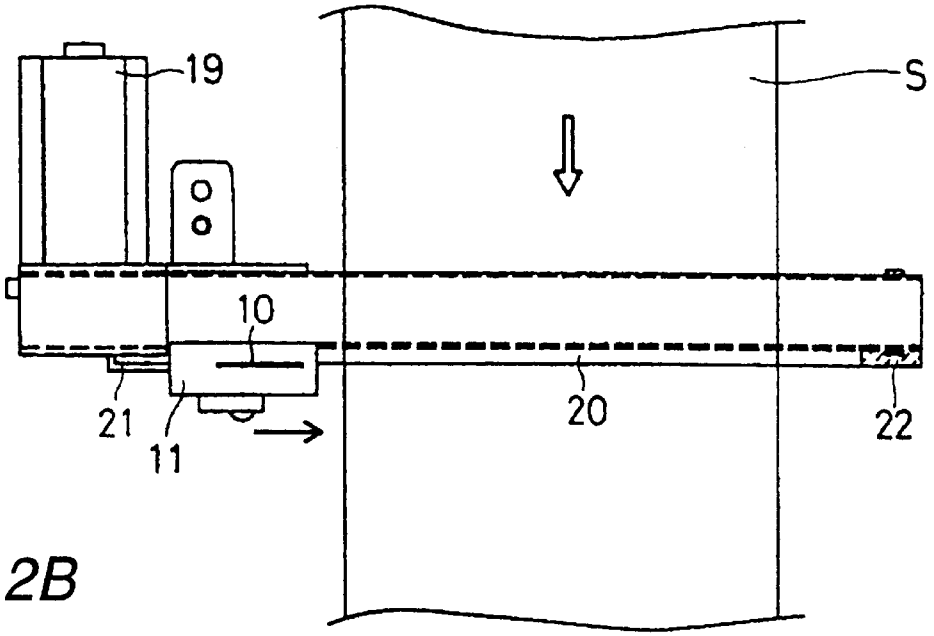
Figure 2B:
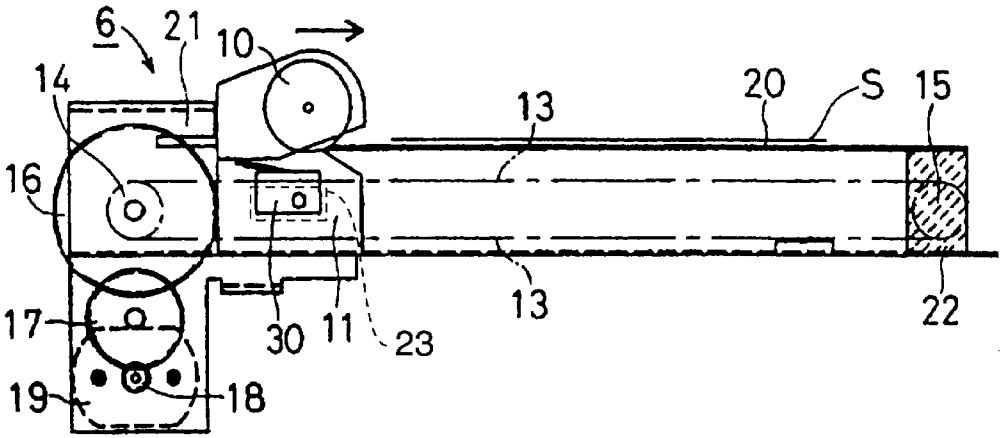
Figure 2C:
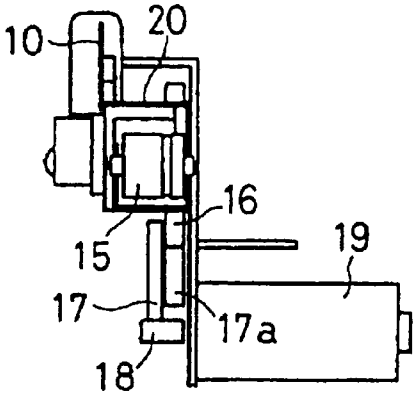

FIGS. 2A to 2C show the structure of the cutter apparatus 6 according to the first embodiment of the invention, in which FIG. 2A is a plan view of the cutter apparatus 6, FIG. 2B is a front view thereof, and FIG. 2C is a side view thereof. A disk-shaped rotary cutter 10 is rotatably supported on a carriage 11. An endless timing belt 13 is provided over and between left and right pulleys 14 and 15, while the carriage 11 is to be engaged with an upper or lower section of the timing belt 13 so as to move reciprocatingly. The pulley 14 can be driven or rotated through gears 16, 17*a*, 17 and 18 by a motor 19.

When, as the motor 19, there is used a reversible motor such as a pulse motor, the reciprocating motion of the carriage 11 can be realized by switching the rotation directions of the motor 19. In this case, by providing a motor control circuit for controlling the rotation amount of the motor 19 as cutting range switching means, the cutting range of the rotary cutter 10 can be switched, that is, it is possible to select either a full cutting mode in which the cutting point of the rotary cutter 10 is allowed to pass through the side end of the record sheet S or a partial cutting mode in which the cutting point of the rotary cutter 10 is caused to stop before the side end of the record sheet S.

Also, to reduce the costs of the printer 1, in the case where a one-way rotary motor such as a DC brush motor is used as the motor 19, as disclosed in Japanese Patent Unexamined Publication No. Hei 10-29193, with provision of an automatically reversing clutch mechanism 23 which is capable of switching the engagement of the carriage 11 with either the upper or lower section of the timing belt 13 in the forward or backward motion of the carriage 11, the reciprocating motion of the carriage 11 can be realized.

The automatically reversing clutch mechanism is structured such that a tooth form is formed over the whole periphery of the inside of the timing belt 13, and a gear having missing teeth in part of the circumference thereof is journaled on the carriage 11, whereby the engagement between the partial-teeth-missing gear and the upper or lower section of the timing belt 13 can be made selectively. The shaft of the partial-teeth-missing gear has an oval cross-section and is held by and between two plate springs. In case where the carriage 11 is contacted with a stopper at a given position and a load exceeding the holding torque of the plate springs is applied, the partial-teeth-missing gear is rotated half to thereby switch the engagement of the partial-teeth-missing gear with the upper section of the timing belt 13 over to the engagement with the lower section of the timing belt 13 or vice versa. Thanks to the automatically reversing clutch mechanism, while the timing belt 13 is moving in one direction, the moving direction of the carriage 11 can be reversed each time the carriage 11 is contacted with the stopper: that is, as shown in FIGS. 2A to 2C, in case where the two stoppers 21 and 22 are positioned in the vicinity of the two sides of the record sheet S, the reciprocating motion of the carriage 11 can be realized.

In this case, as the cutting range switching means, by changing the position of the stopper 22 on the cutting completion side, it is possible to select the full cutting mode in which the cutting point of the rotary cutter 10 is allowed to pass through the side end of the record sheet S or the partial cutting mode in which the cutting point of the rotary cutter 10 stops before the side end of the record sheet S. In FIGS. 2A to 2C, there is shown the full cutting mode in which the stopper 22 is positioned nearest to the end of the cutting completion side.

By the way, the position of the stopper 22 can be changed by operating a screw or a clamp mechanism by hand. Alternatively, the installation position of the stopper 22 can also be changed by a CPU control using another motor or an electromagnetic plunger.

At the home position of the carriage 11, there is disposed a position sensor 30 such as a microswitch; and, the position sensor 30 is used to detect the presence or absence of the return of the carriage 11.

A flat-plate-shaped fixed cutter 20 is disposed so as to extend along the moving direction of the rotary cutter 10. In a state where the record sheet S passes above the fixed cutter 20, the rotary cutter 10 is slid on the edge of the fixed cutter 20 to thereby hold the record sheet S between them and cut the record sheet S. By the way, another structure may be employed in which instead of the fixed cutter 20, there is provided a second rotary cutter in the carriage 11, and the pair of rotary cutters are moving together to thereby hold the record sheet S between them and cut the record sheet S.

Figure 3A:
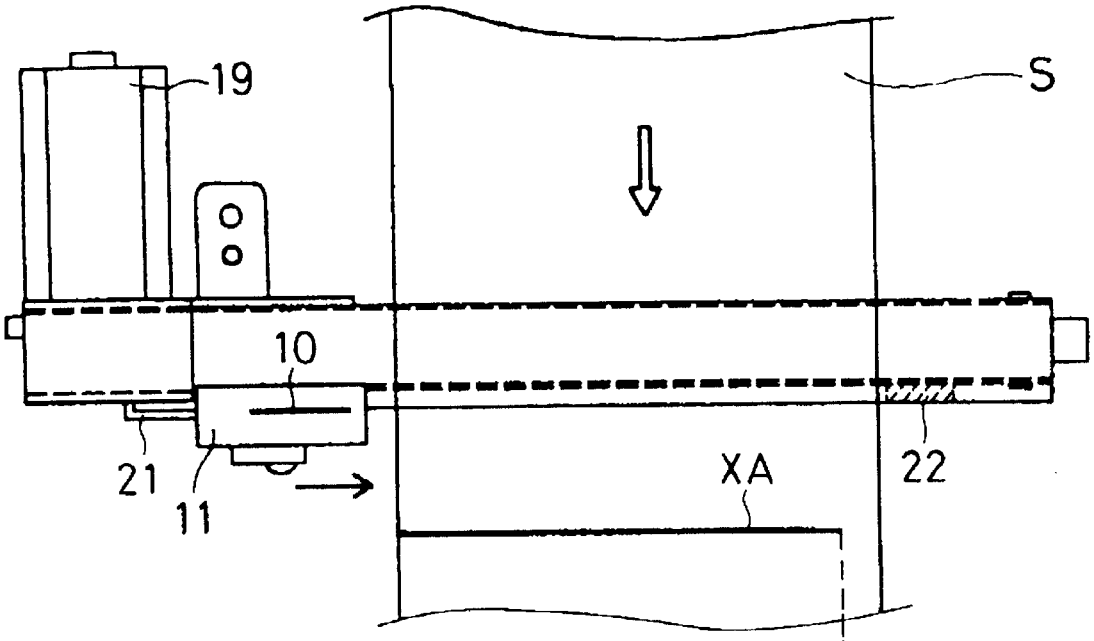
Figure 3B:
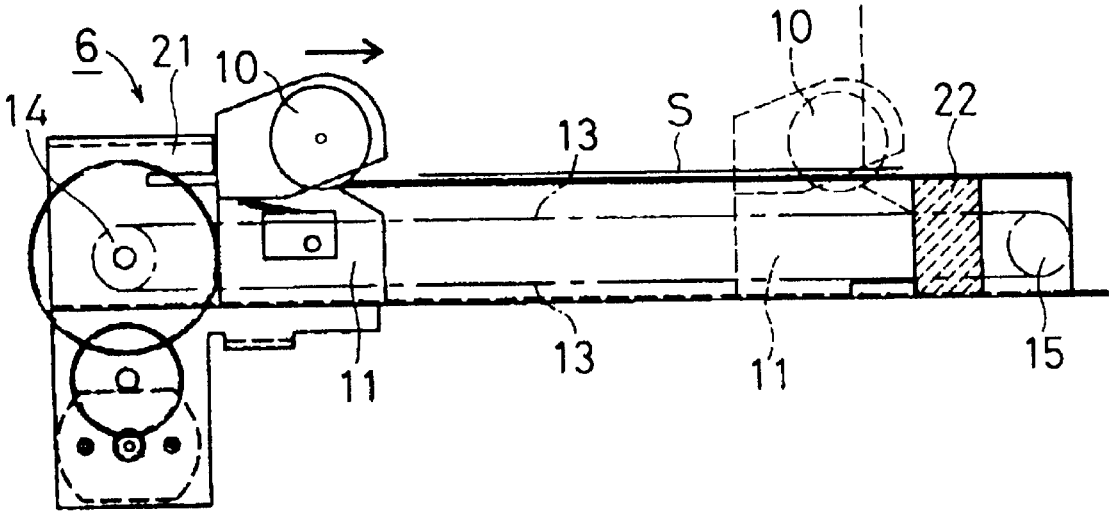

FIGS. 3A and 3B show explanatory views of the operation of the partial cutting mode, in which FIG. 3A is a plan view of the cutter apparatus according to the first embodiment of the invention. Referring to those drawings, the position of the stopper 22 is set nearer to the cutting start side (in FIGS. 3A and 3B, nearer to the left) when compared with FIGS. 2A to 2C.

In the case where the carriage 11 moves right from its home position, the rotary cutter 10 starts to cut the record sheet S at and from the left end thereof, and the carriage 11 is contacted with the stopper 22, the automatically reversing clutch mechanism 23 is operated, so that the cutting point of the rotary cutter 10 stops once before the right end of the record sheet S, and after that, the carriage 11 returns back to the home position. As a result, there is produced an uncut portion in the right end of the record sheet S so as to form a partial cutting line XA. The length of the uncut portion can be adjusted according to the position of the stopper 22: for example, in the case where the stopper 22 is adjusted in such a manner as shown in FIGS. 2A to 2C, the partial cutting mode can be switched over to the full cutting mode in which the uncut portion length is zero.

Subsequently, a second embodiment of the invention will be described hereinafter.

Figure 4A:
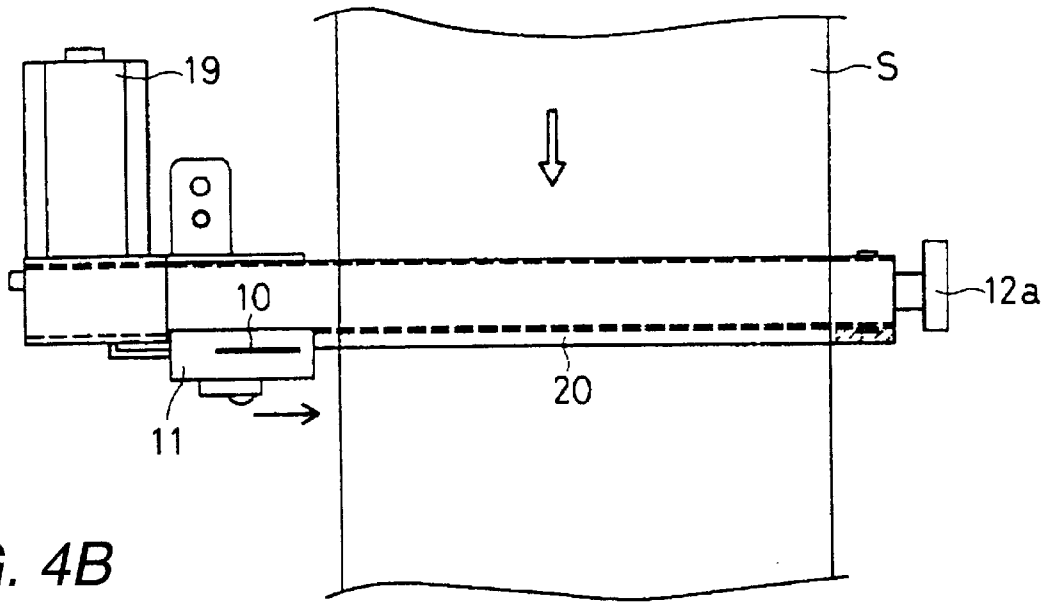
Figure 4B:
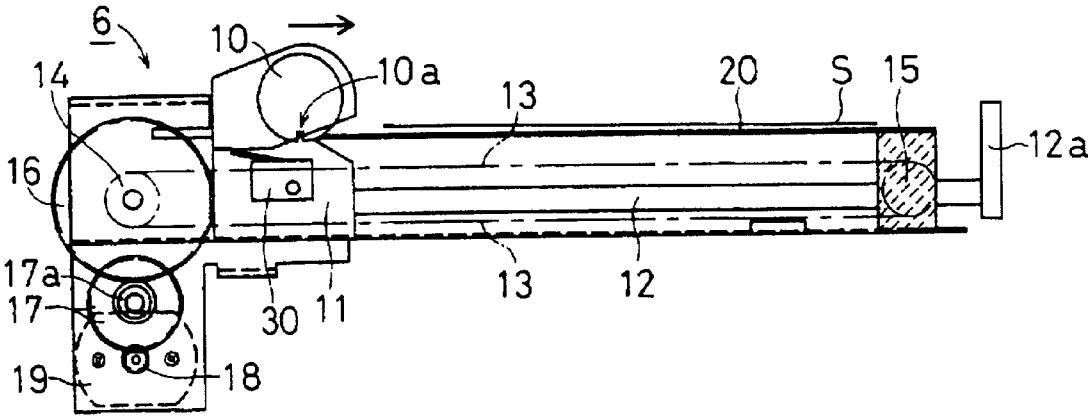
Figure 4C:
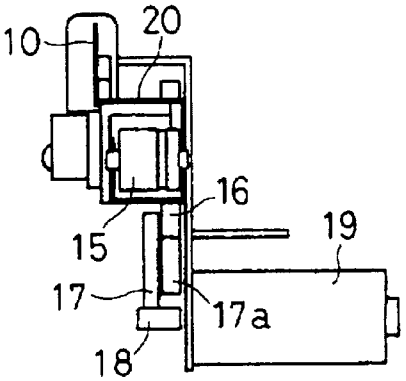

FIGS. 4A to 4C show the structure of a cutter apparatus according to the invention in which FIG. 4A is a plan view thereof, FIG. 4B is a front view thereof, and FIG. 4C is a side view thereof. A disk-shaped rotary cutter 10 is rotatably supported on a carriage 11. An endless timing belt 13 is disposed so as to extend between and over left and right pulleys 14 and 15, while the carriage 11 can be engaged with the upper or lower section of the timing belt 13 so that the carriage 11 is allowed to move in a reciprocating manner.

The pulley 14 can be driven and rotated through gears 16, 17*a*, 17, 17 and 18 by a motor 19. In case where a reversible motor such as a pulse motor is used as the motor 19, the reciprocating motion of the carriage 11 can be realized by switching the rotation direction of the motor 19. Also, in case where a one-way rotary motor such as a DC brush motor is used as the motor 19, as in Japanese Patent Unexamined Publication No. Hei 10-29193, by providing a mechanism which is capable of switching the engagement of the carriage 11 with the upper and lower section of the timing belt 13 in the forward-going and return passages of the carriage 11, the reciprocating motion of the carriage 11 can be realized.

At the home position of the carriage 11, there is disposed a position sensor 30 such as a microswitch; and, the position sensor 30 is used to detect the presence or absence of the return of the carriage 11.

A flat-plate-shaped fixed cutter is disposed so as to extend along the moving direction of the rotary cutter 10. In the case where a record sheet S has passed above the fixed cutter 20, the rotary cutter 10 is slid on the edge of the fixed cutter 20, the fixed and rotary cutters 20 and 10 hold the record sheet S between them so that the record sheet S can be cut. By the way, it is also possible to employ another structure in which, instead of the fixed cutter 20, there is disposed a second rotary cutter in the carriage 11 and, while the pair of rotary cutters are moving together, they hold the record sheet S between them so as to be able to cut the record sheet S.

Further, an eccentric guide shaft 12, which is used to guide the reciprocating motion of the carriage 11, is disposed in parallel to the timing belt 13. The eccentric guide shaft 12 is eccentrically supported in such a manner that the upper and lower positions thereof can be adjusted through the angular shift operation of an operation lever 12*a* which is located on the right side of the present cutter apparatus: that is, since the upper and lower positions of the carriage 11 can be switched to each other by the angular shift operation of the operation lever 12*a*, the relative position between the rotary and fixed cutters 10 and 20 can be changed to thereby be able to adjust the cutting depth of the rotary cutter 10 with respect to the record sheet S. By the way, in FIG. 4C, the illustration of the operation lever 12*a* is omitted. Also, it is also possible to employ another structure in which, instead of the manual operation using the operation lever 12*a*, by means of CPU control using another motor or an electromagnetic plunger, the rotary cutter 10 and the eccentric guide shaft 12 are shifted in position.

A sharp cutting edge is formed on the circumference of the rotary cutter 10, and a notch portion 10*a* is formed in a part of the cutting edge. Therefore, when the operation lever 12*a* is operated such that the cutting depth of the rotary cutter 10 with respect to the record sheet S is allowed to only arrive at the intermediate position of the notch portion 10*a*, the bottom portion of the notch portion 10*a* is prevented from coming into contact with the record sheet S, thereby providing a partial cutting mode. On the other hand, when the operation lever 12*a* is operated such that the cutting depth of the rotary cutter 10 with respect to the record sheet S is equal to or larger than the depth of the notch portion 10*a*, there is produced no uncut portion by the notch portion 10*a*, thereby providing a full cutting mode.

Figure 5:
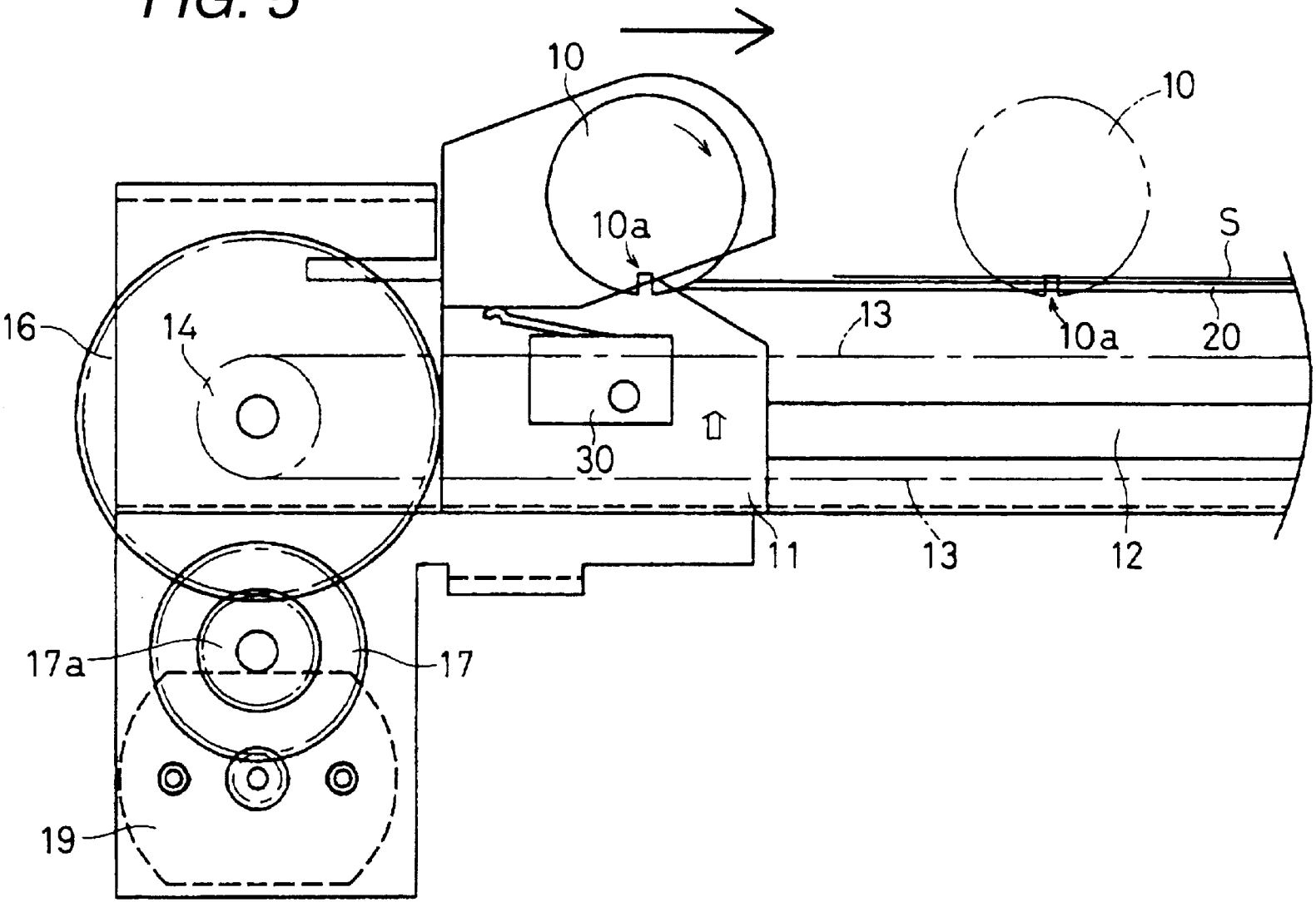
FIG. 5 is an explanatory view of the operation of a partial cutting mode according to the second embodiment of the invention.

FIG. 5 is an explanatory view of the operation of the partial cutting mode. In case where the eccentric guide shaft 12 is shifted upwardly, the carriage 11 and rotary cutter 10 are also positioned upwardly, so that the passing position of the record sheet S is set at a position shallower than the depth of the notch portion 10*a* of the rotary cutter 10. In this state, in case where the carriage 11 is moved to the right, the rotary cutter 10 is rotated and moved to the right, thereby producing an uncut portion in the portion where the notch portion 10*a* passes.

Figure 6:
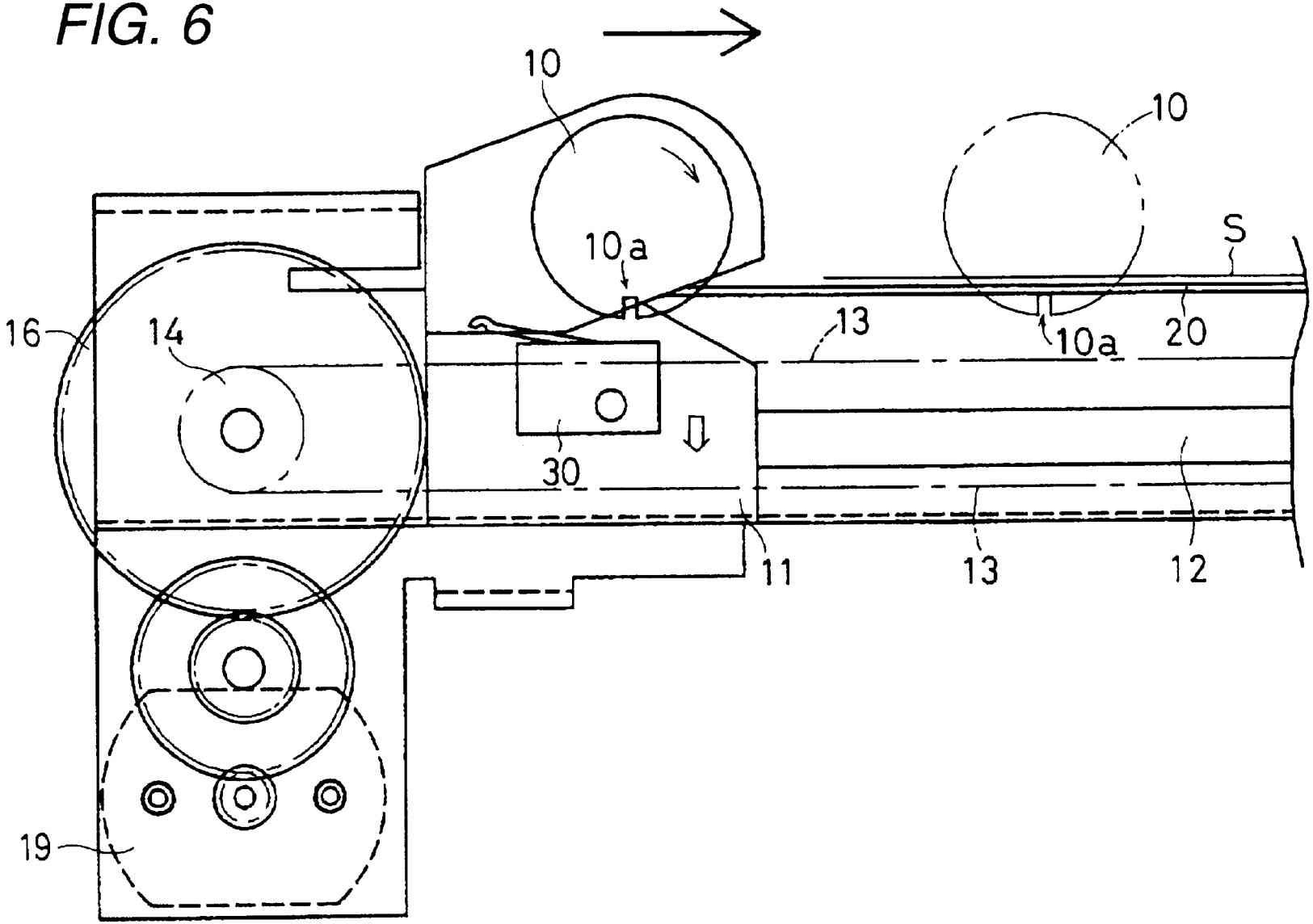
FIG. 6 is an explanatory view of the operation of a full cutting mode according to the second embodiment of the invention.

FIG. 6 is an explanatory view of the operation of the full cutting mode. In case where the eccentric guide shaft 12 is shifted downwardly, the carriage 11 and rotary cutter 10 are also positioned upwardly, so that the passing position of the record sheet S is set at a position deeper than the depth of the notch portion 10*a* of the rotary cutter 10. In this state, in case where the carriage 11 is moved to the right, the rotary cutter 10 is rotated and moved to the right, so that not only the circumferential cutting edge of the rotary cutter 10 but also the notch portion 10*a* thereof cut into the record sheet S, thereby being able to realize the full cutting mode in which the whole of the record sheet S is cut.

Figure 7A:
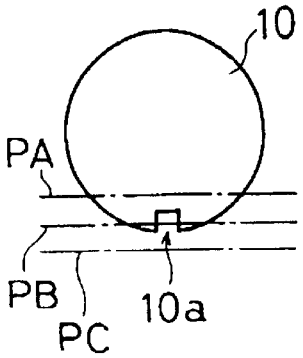
FIGS. 7A and 7B are explanatory views showing the relationship between the position of a rotary cutter and its cutting pitch according to the second embodiment of the invention.
Figure 7B:
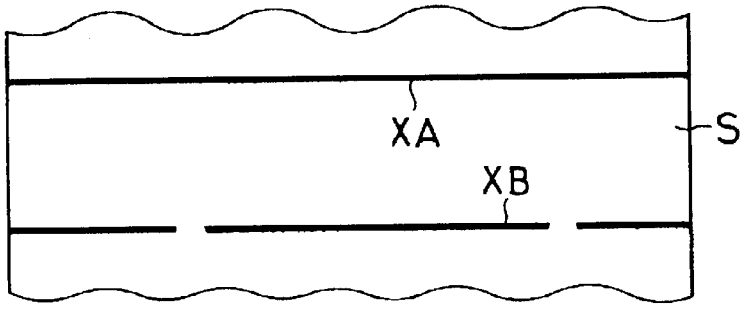

FIGS. 7A and 7B are explanatory views of the relationship between the position of the rotary cutter 10 and its cutting pitch. When the record sheet S is set at a position PA shown in FIG. 7A, the cutting depth of the record sheet S by the rotary cutter 10 is deeper than the depth of the notch portion 10*a* of the rotary cutter 10. As a result of this, as shown in FIG. 7B, a cutting line XA of a full cut type is formed in the record sheet S.

On the other hand, when the record sheet S is set at a position PB shown in FIG. 7A, as shown in FIG. 7B, a cutting line XB of a partially cut type is formed in the record sheet S. In this case, the length of the cutting pitch is almost coincident with the length of the circumference of the rotary cutter 10, which makes it possible to realize the partial cutting mode in which the length of each uncut portion is almost equivalent to the width of the notch portion 10*a*.

When the record sheet S is set at a position PC in FIG. 7A, even the circumferential cutting edge of the rotary cutter 10 does not touch the record sheet S and, therefore, the record sheet S will not be cut.

Figure 8A:
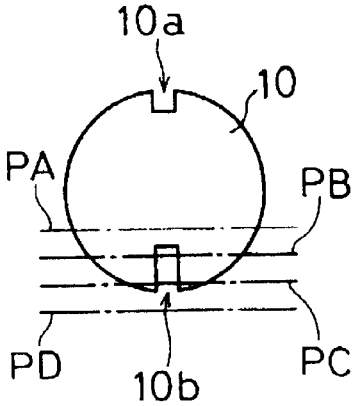
FIGS. 8A and 8B are explanatory views showing the relationship between the position of a rotary cutter including a plurality of notch portions and its cutting pitch according to the second embodiment of the invention.
Figure 8B:
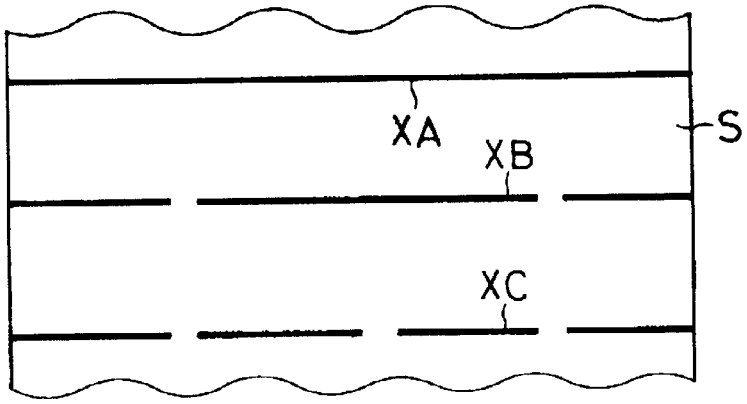

FIGS. 8A and 8B are explanatory views of the relationship between the position of the rotary cutter 10 including a plurality of notch portions and its cutting pitch. In the rotary cutter 10, there are formed a plurality of notch portions 10*a*, 10*b* differing in the cutting depth; and, in this example, the notch portion 10*b* is cut deeper than the notch portion 10*a*.

When the record sheet S is set at a position PA shown in FIG. 8A, the cutting depth of the record sheet S by the rotary cutter 10 is deeper than the depths of the notch portions 10*a*, 10*b* of the rotary cutter 10. As a result of this, as shown in FIG. 8B, in the record sheet S, there is formed a cutting line XA of a full cut type.

When the record sheet S is set at a position PB shown in FIG. 8A, the cutting depth of the record sheet S by the rotary cutter 10 is deeper than the depth of the notch portion 10*a* but is shallower than the depth of the notch portion 10*b* of the rotary cutter 10. As a result of this, as shown in FIG. 8B, a cutting line XB of a partially cut type is formed in the record sheet S.

Further, when the record sheet S is set at a position PC shown in FIG. 8A, the cutting depth of the record sheet S by the rotary cutter 10 is shallower than the depths of the notch portions 10*a*, 10*b* of the rotary cutter 10. As a result of this, as shown in FIG. 8B, in the record sheet S, there is formed a cutting line XC of a partially cut type. In the cutting line XC, when compared with the cutting line XB, the number of the uncut portions increases and thus the pitch thereof is narrowed.

Still further, when the record sheet S is set at a position PD shown in FIG. 8A, even the circumferential cutting edge of the rotary cutter 10 does not touch the record sheet S and, therefore, the record sheet S will not be cut.

As described above, by forming the two notch portions 10*a* and 10*b* differing in the cutting depth, the number of uncut portions in the partial cutting mode can be adjusted. Although there is shown an example in which there are formed the two notch portions 10*a* and 10*b*, three or more notch portions can also be formed.

As has been described heretofore, according to the invention, by switching the cutting ranges of the rotary cutter, the full cutting mode for cutting the record sheet fully or the partial cutting mode for cutting the record sheet partially can be selected simply. Therefore, there can be saved the conventionally required labor to change two kinds of exclusively designed rotary cutters over to each other each time the cutting mode is switched.

Also, according to the present invention, since the relative position between the rotary cutter and sheet member can be switched by the rotary cutter moving mechanism, so that the full cutting mode for cutting the whole of the sheet member or the partial cutting mode for cutting part of the sheet member can be selected simply. This can save the conventionally required labor to replace the two kinds of exclusively designed rotary cutters with each other each time as the need arises.

Further, by forming a plurality of notch portions differing in the cutting depth in the circumference of the rotary cutter and adjusting the cutting depth of the notch portions step by step, the number of uncut portions in the partial cutting mode can be adjusted arbitrarily.

What is claimed is:

1. A cutter apparatus, comprising:

a rotary cutter supported rotatably and having a cutting edge formed on the circumference thereof;

an opposite cutter disposed opposed to said rotary cutter for holding a sheet member in association with said rotary cutter;

a carriage mechanism which moves said rotary cutter reciprocatingly along a cutting line; and switching means for switching a cutting mode between a full cutting mode in which said rotary cutter fully cuts the sheet member and a partial cutting mode in which said rotary cutter partially cuts the sheet member, wherein said cutting edge of said rotary cutter has a notch portion formed in a part thereof, and said switching means comprises a rotary cutter moving mechanism for changing the cutting depth of said rotary cutter with respect to said sheet member.

2. A cutter apparatus as claimed in claim 1, wherein a plurality of notch portions having differing notch depths from one another are formed in the circumference of said rotary cutter.

3. A printer, comprising:

a sheet delivery mechanism for delivering a sheet member;

a print mechanism for printing said sheet member delivered by said sheet delivery mechanism; and a cutter mechanism for cutting said sheet member which has passed through said print mechanism;

wherein said cutter mechanism comprises:

a rotary cutter supported rotatably and having a cutting edge formed on the circumference thereof;

an opposite cutter disposed opposed to said rotary cutter for holding a sheet member in association with said rotary cutter;

a carriage mechanism which moves said rotary cutter reciprocatingly along a cutting line; and switching means for switching a cutting mode between a full cutting mode in which said rotary cutter fully cuts the sheet member and a partial cutting mode in which said rotary cutter partially cuts the sheet member, wherein the cutting edge of said rotary cutter has a notch portion formed in a part thereof, and said switching means comprises a rotary cutter moving mechanism for changing the cutting depth of said rotary cutter with respect to said sheet member.

4. The printer as claimed in claim 3, wherein a plurality of notch portions different in the notch depth from one another are formed in the circumference of said rotary cutter.

5. A cutter apparatus, comprising:

a rotary cutter supported rotatably and having a cutting edge formed on the circumference thereof;

an opposite cutter disposed for holding a sheet member in association with said rotary cutter;

a carriage mechanism that supports said rotary cutter;

a stopper, a mounting position of which is variable to adjust a movement range of said carriage for selectively switching a cutting mode between a full cutting mode and a partial cutting mode;

a pair of pulleys disposed on both ends of the sheet member;

an endless belt extending between and over said pulleys; and a clutch mechanism for switching a portion to be engaged with said carriage to one of a forward side belt and a backward side belt of said endless belt every time said carriage abuts against said stopper.

6. A printer, comprising:

a sheet delivery mechanism for delivering a sheet member;

a print mechanism for printing said sheet member delivered by said sheet delivery mechanism;

a rotary cutter supported rotatably and having a cutting edge formed on the circumference thereof;

an opposite cutter disposed for holding a sheet member in association with said rotary cutter;

a carriage mechanism that supports said rotary cutter;

a stopper, a mounting position of which is variable to adjust a movement range of said carriage for selectively switching a cutting mode between a full cutting mode and a partial cutting mode;

a pair of pulleys disposed on both ends of the sheet member;

an endless belt extending between and over said pulleys; and a clutch mechanism for switching a portion to be engaged with said carriage to one of a forward side belt and a backward side belt of said endless belt every time said carriage abuts against said stopper.

* * * * *